US005654628A

United States Patent [19]

Feldtkeller

[11] Patent Number: 5,654,628

[45] Date of Patent: Aug. 5, 1997

[54] CIRCUIT CONFIGURATION FOR GENERATING A CONTROLLED OUTPUT VOLTAGE

[75] Inventor: Martin Feldtkeller, München, Germany

[73] Assignee: Siemens Aktiengesellschaft, Munich, Germany

[21] Appl. No.: 564,502

[22] Filed: Nov. 29, 1995

[30] Foreign Application Priority Data

Nov. 29, 1994 [DE] Germany ..... 44 42 466.3

[51] Int. Cl.[6] ..... G05F 1/40; G05F 1/44; G05F 1/56

[52] U.S. Cl. ..... 323/282; 323/280; 323/289

[58] Field of Search ..... 323/273, 278, 323/280, 282, 289, 312

[56] References Cited

U.S. PATENT DOCUMENTS

| | | | |
|---|---|---|---|
| 5,387,882 | 2/1995 | Schoofs | 327/131 |
| 5,552,697 | 9/1996 | Chan | 323/282 |
| 5,592,120 | 1/1997 | Palmer et al. | 327/157 |

FOREIGN PATENT DOCUMENTS

| | | |
|---|---|---|
| 3716880 | 12/1988 | Germany . |
| 3010618 | 3/1989 | Germany . |

OTHER PUBLICATIONS

Electronic Design, Oct. 14, 1993, "Microcontroller Switches 5–A, 60–V Current Pulses" Goodenough pp. 71–79.

Halbleiterschaltungsstechnik [Semiconductor Circuitry], 9th Ed 1991, Chapter 18.3.4, pp. 547–549 (Tietze–Schenk).

*Primary Examiner*—Peter S. Wong
*Assistant Examiner*—Bao Q. Vu
*Attorney, Agent, or Firm*—Herbert L. Lerner; Laurence A. Greenberg

[57] ABSTRACT

A circuit configuration for generating a controlled output voltage from an uncontrolled input voltage, includes an input terminal for supplying the uncontrolled input voltage, and an output terminal for pickup of the controlled output voltage. A transistor has a load current path being connected between the input terminal and the output terminal. A controlled-gain amplifier has an input terminal for receiving the controlled output voltage and has an output terminal. A capacitor couples the output terminal of the controlled-gain amplifier with a control terminal of the transistor. A current source for discharging the capacitor is controllable by the controlled-gain amplifier. A charge pump has an output terminal for an increased voltage being connected to the control terminal of the transistor, for supplying an output voltage being controllable by the controlled-gain amplifier.

10 Claims, 1 Drawing Sheet

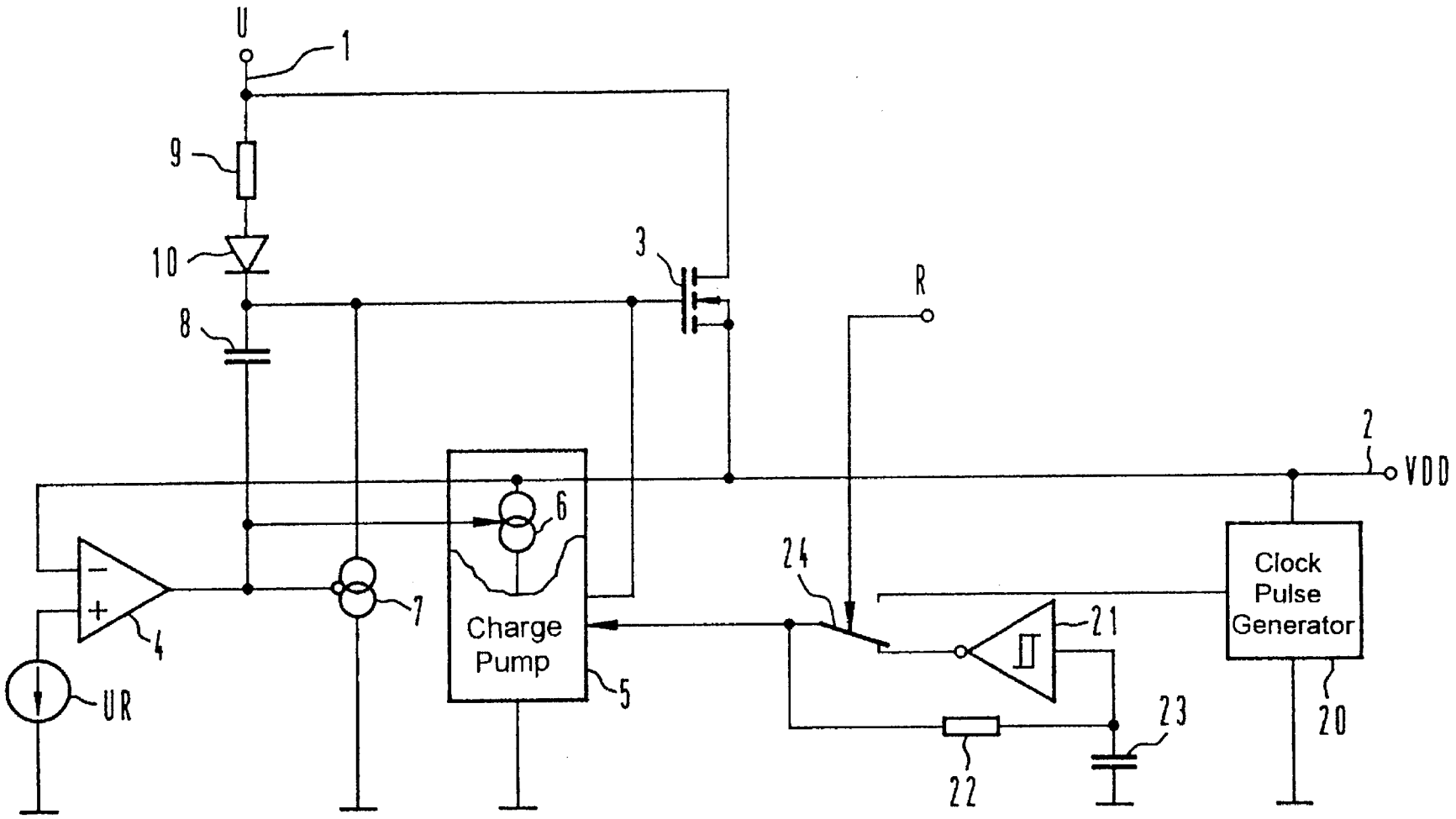
VDD
2
Clock Pulse Generator
20
23
21
22
R
24
3
5
6
Charge Pump
7
1
U
9
10
8
4
UR

CIRCUIT CONFIGURATION FOR GENERATING A CONTROLLED OUTPUT VOLTAGE

BACKGROUND OF THE INVENTION

Field of the Invention

The invention relates to a circuit configuration for generating a controlled output voltage from an uncontrolled input voltage, having a transistor with a load current path connected between an input terminal for supplying the uncontrolled input voltage and an output terminal for picking up the controlled output voltage, and a controlled-gain amplifier for receiving the controlled output voltage, the controlled-gain amplifier having an output terminal being coupled to a control terminal of the transistor.

Voltage controllers are necessary if a supply voltage that can be supplied from outside is subject to major fluctuation, yet function units to be supplied require the most constant possible operating voltage. In order to obtain a large allowable range of fluctuation of the input voltage, so that the supplied function units still work even at the lowest possible input voltage, it is necessary for the voltage drop between the output and the input voltage to be as slight as possible. Such demands are made in the area of motor vehicle electronics, for instance.

Voltage controllers with low voltage loss are described, for instance, in the textbook by Tietze and Schenk, entitled: "Halbleiterschaltungsstechnik" [Semiconductor Circuitry], 9th Edition, 1991, Chapter 18.3.4, pp. 547–549. The load current path of a pnp transistor is connected between the terminal for the uncontrolled input voltage and the terminal for the controlled output voltage, its emitter is connected to the input-side terminal and its collector to the output-side terminal. Nowadays, the function units to be supplied by the voltage controller are typically made with CMOS technology, with which a large scale integration at low cost is possible, with only slight power loss. If the voltage controller is to be disposed together with the function units to be supplied on the CMOS integrated circuit for the sake of the highest possible scale of integration, problems arise in making the control transistor. Producing that kind of bipolar pnp control transistor, that is constructed for high current consumption, is not readily possible using CMOS production processes.

German Published, Non-Prosecuted Patent Application DE 37 16 880 A1 shows a voltage control circuit in which the load current path of an MOS transistor is connected between the input terminal for the connection of an uncontrolled direct battery voltage and the output terminal at which the controlled output voltage for connecting a load is present. A controlled-gain amplifier circuit, to which the controlled output voltage can be supplied, assures triggering of the MOS transistor. The supply voltage of the controlled-gain amplifier is furnished by a voltage chopper circuit, which provides for doubling of the voltage so that the MOS transistor is fully driven.

In the publication Electronic Design, "Microcontroller Switches 5-A, 60-V Current Pulses", Oct. 14, 1993, pp. 71–79, a circuit for triggering MOS transistors is shown in which a high-side switch is triggered by a charge pump. The charge pulse generates a voltage that is above the MOS transistor supply voltage.

German Patent DE 30 10 618 C2 shows a constant voltage circuit in which the emitter-to-collector path of a bipolar transistor having a base terminal that is controlled by a control circuit is located in the input/output current path. A startup circuit assures secure starting up of the circuit. The startup stage includes a capacitor having a first terminal which is connected to the uncontrolled input voltage and a second terminal which is connected to ground through a resistor. The second terminal of the capacitor is also carried through a resistor and a diode to the control circuit.

SUMMARY OF THE INVENTION

It is accordingly an object of the invention to provide a circuit configuration for generating a controlled output voltage, which overcomes the hereinafore-mentioned disadvantages of the heretofore-known devices of this general type and which can be made entirely by CMOS technology. It should have both the smallest possible power loss and good control performance.

With the foregoing and other objects in view there is provided, in accordance with the invention, a circuit configuration for generating a controlled output voltage from an uncontrolled input voltage, comprising an input terminal for supplying an uncontrolled input voltage, and an output terminal for pickup of a controlled output voltage; a transistor having a load current path being connected between the input terminal and the output terminal and having a control terminal; a controlled-gain amplifier for receiving the controlled output voltage, the controlled-gain amplifier having an output terminal, and a capacitor coupling the output terminal of the controlled-gain amplifier with the control terminal of the transistor; a current source for discharging the capacitor, the current source being controllable by the controlled-gain amplifier; and a charge pump having an output terminal for an increased voltage being connected to the control terminal of the transistor, for supplying an output voltage being controllable by the controlled-gain amplifier.

The capacitor that couples the output of the controlled-gain amplifier to the control terminal of the transistor assures that the output voltage will compensate for even rapid output-side load changes. The charge pump assures the relatively slow static control of the control transistor. Accordingly, the charge pump can be dimensioned for a low power consumption. Therefore, the capacitors that are known to be necessary in the charge pump can be dimensioned to be relatively small. Accordingly, the integrated embodiment of the voltage controller requires less current and less surface area.

In accordance with another feature of the invention, the control transistor is an MOS transistor having a drain-to-source current path which is connected between the input and output terminals. All of the circuit elements of the voltage controller can then be produced with integrated CMOS technology, with the capability of integrating MOS power transistors. A DMOS power transistor is preferably suitable. The controlled-gain amplifier preferably has a high bandwidth and a low output resistance.

In accordance with a further feature of the invention, the capacitance of the capacitor connected between the controlled-gain amplifier output and the control input of the control transistor is on the order of magnitude of the input capacitance of the MOS transistor, and preferably in the range from one-quarter to one times the input capacitance of the MOS transistor.

Charge pumps are known to function under clock control. In accordance with an added feature of the invention, in order to furnish the working clock pulse of the charge pump, the integrated semiconductor circuit has a clock pulse preparation circuit, which is optionally synchronized with an internal clock pulse. Since the clock pulse preparation circuit is supplied with the controlled output voltage, there is no reliable clock signal available for charging the charge pump when the uncontrolled input voltage is switched on. It is therefore necessary that the controlled output voltage and thus proper function of the charge pump already be available before the clock generating circuit is activated.

In accordance with a concomitant feature of the invention, when the system is turned on, which is indicated, for instance, by a corresponding state of a reset signal, the clock pulse supplied at the charge pump is furnished by a freely-oscillating oscillator. By way of example, this is an RC element fed back through a Schmitt trigger. Once the output voltage is available in controlled form, the reset signal is turned off, and the multiplexer controlled by the reset signal disconnects the feedback of the RC element, so that then the system clock pulse, which is present in stable form, is fed into the charge pump. What is also attained thereby is that the charge pump functions synchronously with the system clock, and no disruptions from superposition of oscillations are caused.

Other features which are considered as characteristic for the invention are set forth in the appended claims.

Although the invention is illustrated and described herein as embodied in a circuit configuration for generating a controlled output voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The FIGURE of the drawing is a schematic circuit diagram illustrating an embodiment of the invention.

DESCRIPTION OF THE PREFERRED EMBODIMENTS

Referring now to the single FIGURE of the drawing in detail, there is seen a fundamental realization of a voltage control circuit and a circuit for furnishing a clock signal for a charge pump. An uncontrolled input voltage U is supplied to an input terminal 1. The terminal 1 is connected through a drain-to-source path of a self-blocking n-channel MOS transistor 3 to an output terminal 2 for pickup of a controlled output voltage VDD. The output voltage VDD is delivered to a negative input of a controlled-gain amplifier 4. The controlled-gain amplifier 4 has a positive input which is connected to a reference voltage UR. An output of the controlled-gain amplifier 4 is coupled through a capacitor 8 to a gate terminal of the MOS transistor 3. A first controllable current source 7 which is connected between the gate terminal of the MOS transistor 3 and a ground potential (ground), is triggered in inverted form by an output signal of the controlled-gain amplifier 4. A charge pump 5 which is also provided has an output terminal that is connected to the gate terminal of the MOS transistor 3, for the sake of an increased output voltage. A second current source 6 is provided in the charge pump 5. The current source 6 is controlled in the same direction by the output signal of the controlled-gain amplifier 4. The level of the output voltage generated by the charge pump can be controlled through the use of the current source 6.

The voltage control circuit functions as follows: if the controlled output voltage VDD at the terminal 2 drops, for example as a result of a varying load, then the control deviation formed by the controlled-gain amplifier 4 is increased. The output signal of the controlled-gain amplifier 4 rises. The voltage rise is transmitted through the capacitor 8 to the gate terminal of the MOS transistor 3. The voltage at the terminal 2 is increased through the use of the relatively constant voltage drop along the gate-to-source path of the MOS transistor 3. The current through the current source 7 that discharges the capacitor 8 is reduced, because of the contrary triggering from the output of the controlled-gain amplifier 4. The dynamic performance of the control circuit in the event of rapid load changes in the output voltage is determined substantially by the capacitive coupling of the controlled-gain amplifier output to the control input of the control transistor.

The static adjustment of the gate potential of the transistor 3 is effected through the charge pump 5. The current which is impressed by the current source 6, in the operating state under consideration at present, is increased through the use of the rising output signal of the controlled-gain amplifier 4. This assures that the output voltage of the charge pump 5 is increased. The gate voltage of the MOS transistor 3 is statically supported as a result. The current source 6 draws its current from the output voltage terminal, which is readjusted through the use of the static control. Since the charge pump 5 only needs to follow the output voltage fluctuations at the terminal 2 relatively slowly, the charge pump can be dimensioned for a relatively slight power consumption. The capacitances provided in the charge pump 5, in the form of at least one charge capacitor and one inversely charging capacitor, can be dimensioned to be relatively small. Since in monolithic integration, capacitors are critical in terms of surface area, the entire voltage control circuit requires little surface area.

Nowadays, production processes are known in which logic circuits can be produced together with MOS power transistors on an integrated circuit. With such MOS transistors, during practical tests, a voltage drop at the MOS transistor and correspondingly a difference between the output voltage VDD and the input voltage U of approximately 0.4 V has been attained. The entire circuit can accordingly be operated even at a relatively low input voltage U.

In order to provide for transient response of the control, a startup circuit is provided and is connected between the terminal 1 for the input voltage U and the gate terminal of the MOS transistor 3. The startup circuit includes a current limiting resistor 9 and a diode 10 having a cathode terminal which is connected to the gate terminal of the MOS transistor 3. When the input voltage U is turned on, the capacitor 8 and the capacitors present in the charge pump 5 are uncharged. The output voltage VDD is therefore at a level of about 0 V. Through the use of the startup circuit, the gate terminal of the MOS transistor 3 is then coupled through the diode 10 to the input voltage U, so that an initial operating voltage is present at the terminal 2. The input voltage U must be at least high enough to ensure that this initial operating voltage suffices so that the control circuit will respond. The current limiting resistor 9 should be dimensioned with relatively high impedance, so that the current source 7 in the steady state will not be overloaded.

It has been found that with increasing capacitance of the capacitor 8, the output voltage fluctuation can be dynamically corrected increasingly fast. In order to nevertheless keep the surface area requirement of the capacitor 8 as slight as possible, its capacitance should expediently be approximately on the order of magnitude of the input capacitance of the gate terminal of the MOS transistor 3. In practice, good controlled performance is still attained if the capacitor 8 has a capacitance of one-quarter the input capacitance of the MOS transistor 3.

The charge pump 5 can be realized in accordance with conventional circuitry principles. By way of example, it may include a charge capacitor at which the increased output voltage can be picked up. The charge capacitor is charged and inversely charged by an inversely charging capacitor. This inversely charging capacitor is charged during a first switching phase from the supply voltage, and during a second switching phase the stored charge is transferred, with inversed orientation, to the charge capacitor. This is known to require clock control. In the steady state, the clock control for the charge pump 5 is supplied from a clock pulse generating device 20 that is typically provided in the integrated circuit. The device 20 assures functionally proper clock pulse preparation and distribution to all of the function units of the integrated circuit. It is supplied with voltage from the controlled supply voltage VDD at the terminal 2. For this reason, the clock pulse generating device 20 is not yet active when the input voltage U is switched on. The clock pulse for the charge pump that is necessary for the transient response of the control is therefore supplied during the transient response phase by a freely oscillating oscillator 21–23. A multiplexer 24 is provided for a switchover between the clock signal generated from the freely oscillating oscillator 21–23 and the clock signal generated from the clock pulse generating device 20. An input of the multiplexer 24 for controlling the switch setting is controlled by a signal R. The signal R is the typically present reset signal, which is active as long as the transient response phase prevails and the controlled output voltage VDD has not yet reached its command or setpoint value. The freely oscillating oscillator includes an RC element 22, 23, having an output which is fed back to its input through a Schmitt trigger 21. Once the output voltage VDD has reached its command value, the reset signal R is deactivated, so that the multiplexer 24 switches over to the clock pulse generating circuit 20 and the feedback of the freely oscillating oscillator is disconnected. The charge pump then oscillates synchronously with the system clock. It is then unable to cause any disruptions resulting from superposition of oscillations. During the transient response phase, the freely oscillating oscillator, and in particular the Schmitt trigger 21, can be supplied from the initially present operating voltage VDD.

The active reset signal R can by way of example be activated at a predetermined length of time after the turn-on, for example by using a time delay circuit. The time delay must be dimensioned to be long enough to ensure that the controlled output voltage VDD is stably present at the command value.

As an alternative to this, the reset signal R can be derived from the internal operating state of the circuit shown. To that end, the voltage VDD at the terminal 2 is picked up and compared with a suitably chosen threshold. If the threshold is exceeded, the output voltage VDD is present in stable form. The reset signal R is then turned off, so that the reversing switch 24 switches over to the clock pulse generating device 20.

I claim:

1. A circuit configuration for generating a controlled output voltage from an uncontrolled input voltage, comprising:

an input terminal for supplying an uncontrolled input voltage, and an output terminal for pickup of a controlled output voltage;

a transistor having a load current path being connected between said input terminal and said output terminal and having a control terminal;

a controlled-gain amplifier for receiving the controlled output voltage, said controlled-gain amplifier having an output terminal, and a capacitor coupling said output terminal of said controlled-gain amplifier with said control terminal of said transistor;

a current source for discharging said capacitor, said current source being controllable by said controlled-gain amplifier; and a charge pump having an output terminal for an increased voltage being connected to said control terminal of said transistor, for supplying an output voltage being controllable by said controlled-gain amplifier.

2. The circuit configuration according to claim 1, wherein a current impressed by said controllable current source decreases and the output voltage of said controllable charge pump increases, with increasing control deviation.

3. The circuit configuration according to claim 1, wherein said controllable current source is a first controllable current source, and said charge pump includes a second controllable current source being controlled in a contrary direction from said first controllable current source.

4. The circuit configuration according to claim 1, including a startup device connected between said input terminal and said control input of said transistor, for making said transistor conducting upon turn-on of the input voltage.

5. The circuit configuration according to claim 1, wherein said transistor has a given input capacitance, and said capacitor has a capacitance in a range of from one-quarter to one times said given input capacitance.

6. The circuit configuration according to claim 1, wherein said transistor is an MOS transistor having a drain terminal being connected to said input terminal for the uncontrolled input voltage and having a source terminal being connected to said output terminal for the controlled output voltage.

7. The circuit configuration according to claim 1, including a clock pulse generating device being supplied by the output voltage for supplying said charge pump with a clock signal.

8. The circuit configuration according to claim 7, wherein said clock pulse generating device includes a device for supplying other function units present on a common integrated circuit for purposes of clock control, a freely oscillating oscillator, and a switchover device for supplying said charge pump with a clock signal either from said device supplying the other function units or from said freely oscillating oscillator, as a function of an input signal.

9. The circuit configuration according to claim 8, wherein said switchover device can interrupt a feedback existing on said freely oscillating oscillator.

10. The circuit configuration according to claim 8, wherein said freely oscillating oscillator includes an amplifier with hysteresis and an RC element having an input and having an output being fed back to said input through said amplifier with hysteresis.

* * * * *